US007665817B2

(12) United States Patent
Folkins

(10) Patent No.: US 7,665,817 B2
(45) Date of Patent: Feb. 23, 2010

(54) DOUBLE REFLEX PRINTING

(75) Inventor: Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 260 days.

(21) Appl. No.: 11/605,735

(22) Filed: Nov. 29, 2006

(65) Prior Publication Data

US 2008/0124158 A1 May 29, 2008

(51) Int. Cl.
*B41J 29/38* (2006.01)
*B41J 3/00* (2006.01)

(52) U.S. Cl. ..... 347/14; 347/2

(58) Field of Classification Search ..... 347/2, 347/14

See application file for complete search history.

(56) References Cited

U.S. PATENT DOCUMENTS 5,231,428 A 7/1993 Domoto et al.
5,397,276 A * 3/1995 Chang ..... 474/148
6,972,403 B2 12/2005 Martenson et al.
7,530,659 B2 * 5/2009 Doherty et al. ..... 347/19
2002/0088356 A1 * 7/2002 Van Den Brink et al. .... 101/219
2005/0263958 A1 12/2005 Knierim et al.
2006/0221124 A1 10/2006 Guarino et al.

* cited by examiner

*Primary Examiner*—Julian D Huffman
(74) *Attorney, Agent, or Firm*—Fay Sharpe LLP

(57) ABSTRACT

A registration system suited to use in an imaging system, such as an inkjet printer, includes a first measuring device, such as an encoder, which provides information for monitoring a speed of a moving image receiving surface of the imaging system, such as a paper web. A second measuring device, such as a second encoder or a tension measuring device, provides information for monitoring a tension in the image receiving surface. A control system determines an actuation time for one of two marking stations, based on the information from the first and second measuring devices. This enables a registration of images applied to the image receiving surface by the two marking stations to take into account both changes in speed of the web and changes in tension in the web.

31 Claims, 5 Drawing Sheets

DOUBLE REFLEX PRINTING

BACKGROUND

The exemplary embodiment relates to registration of images in printing systems. It finds particular application in connection with a registration system for a multicolor printing system which compensates for fluctuations in the position of an image receiving surface between marking stations.

To provide accurate printing of images, multicolor digital marking systems need to maintain adequate color to color registration. In systems that utilize an elongate image receiving surface, such as a paper web or a belt, the receiving surface reaches a first marking station where a marking material of a first color is applied to the surface, e.g., by firing ink jets, exposing an image on a photoconductive material, or applying toner particles to a selectively imaged photoconductive member. The receiving surface then moves on to a second marking station, where an image or marking material of a second color is applied, and so forth, depending on the number of colors. The timing of the actuation of the second marking station is controlled as a function of the speed of the image receiving surface so that the images applied by the two marking stations are registered one on top of the other to form a composite, multicolor image. A high degree of process direction alignment can be achieved by implementing what is generally known as reflex printing, where the speed or position of the image receiving surface is measured with an encoder at a certain location and then the images are timed accordingly. For example, an encoder is associated with a drive nip roller. The rotational speed of the roller is used to calculate the speed of the image receiving surface passing through the nip. The time for actuating the first, second, and subsequent marking stations is then calculated, based on their respective distances from the drive nip roller and the determined speed of the image receiving surface.

In the case of an electrophotographic printer, an encoder may be placed on the photoreceptor belt to measure the exact speed of the belt at each instant of time. The timing from this signal can then be used to time the firing of the laser raster output scanner (ROS) or light emitting diode (LED) bar so that an even spacing of lines is imaged on the photoreceptor, thus compensating for any variability in the photoreceptor speed from a set speed. In a multicolor system, the timing from the encoder can also be used to determine the exact time to fire successive color images to obtain good color on color registration, again compensating for any photoreceptor speed variations.

An implicit assumption of such reflex printing systems is that the belt or web is infinitely stiff (i.e., it does not stretch or change length) such that the encoder measurement of the web or belt velocity enables an exact prediction of correct registration. In situations where the belt or web exhibits any sizeable amount of stretch or deformation, reflex printing techniques may still be subject to misregistration errors.

INCORPORATION BY REFERENCE

The following references, the disclosures of which are incorporated by reference in their entireties, are mentioned:

U.S. Pat. No. 5,231,428, entitled IMAGING DEVICE WHICH COMPENSATES FOR FLUCTUATIONS IN THE SPEED OF AN IMAGE RECEIVING SURFACE, by Domoto, et al., discloses a motion detector which monitors the speed of an imaging surface and determines a difference between the actual speed and the set speed.

U.S. Published Application No. 20050263958, entitled PRINT MEDIA REGISTRATION USING ACTIVE TRACKING OF IDLER ROTATION, by Knierim, et al., discloses a sheet registration system for a moving sheets path for accurately correcting a sheet position relative to a desired sheet trajectory. The system includes a frictional sheet drive roller with a drive system and a mating undriven idler roller forming a nip therebetween. The undriven idler roller has a rotary encoder connected thereto to produce encoder electrical signals which are provided to a control system to control the drive system driving the frictional sheet drive roller.

U.S. Published Application No. 20060221124 entitled REFLEX PRINTING WITH PROCESS DIRECTION STITCH ERROR CORRECTION, by Guarino, et al., discloses a reflex printing device having multiple print heads mounted at different angular locations around the circumference of the drum and an encoder disk mounted on the drum to allow for detection of the drum position as a function of time. An image defect due to a misalignment in the print process direction of the output from the multiple print heads is corrected by detection of an encoder position error function subtracted from itself shifted by the angle between the print heads.

BRIEF DESCRIPTION

In accordance with one aspect of the exemplary embodiment, an imaging system includes an image receiving surface which is moved in a downstream direction. A first marking station applies a first image to the image receiving surface. A second marking station, downstream of the first marking station, applies a second image to the image receiving surface. First and second measuring devices which output time varying information related to the moving image receiving surface. A control system is in communication with the first and second marking stations. The control system is configured for determining a modified actuation time of at least one of the first and second marking stations based on the information provided by the first and second measuring devices.

In accordance with another aspect, a method of registering images is provided. The method includes moving an image receiving surface and applying images to the image receiving surface at first and second spaced image applying positions. The speed of the image receiving surface at a first monitoring position spaced from the first and second image applying positions is monitored and a tension in the image receiving surface is monitored. Timing of at least one of the application of the first and second images is controlled in response to the monitored speed and tension in the image receiving surface.

In another aspect, a registration system includes first and second measuring devices which output time varying information related to an associated moving image receiving surface. A control system determines a relative actuation time for first and second associated marking stations, based on the time varying information from the first and second measuring devices, whereby variations in speed and tension in the image receiving surface are taken into account in registration of images generated by the first and second marking stations which are applied to the image receiving surface at spaced positions.

In another aspect, a registration system includes an encoder associated with a first roller which guides an associated image receiving surface and at least one of a second encoder associated with a second roller which guides the image receiving surface and a tension measuring device which provides information on a tension of the surface. A control system receives information from the encoder and the at least one of the second encoder and the tension measuring device and determines an actuation time for a marking station for registering an image applied to the image receiving surface by the marking station with an image applied to the receiving surface by another marking station.

DETAILED DESCRIPTION

Figure 1:
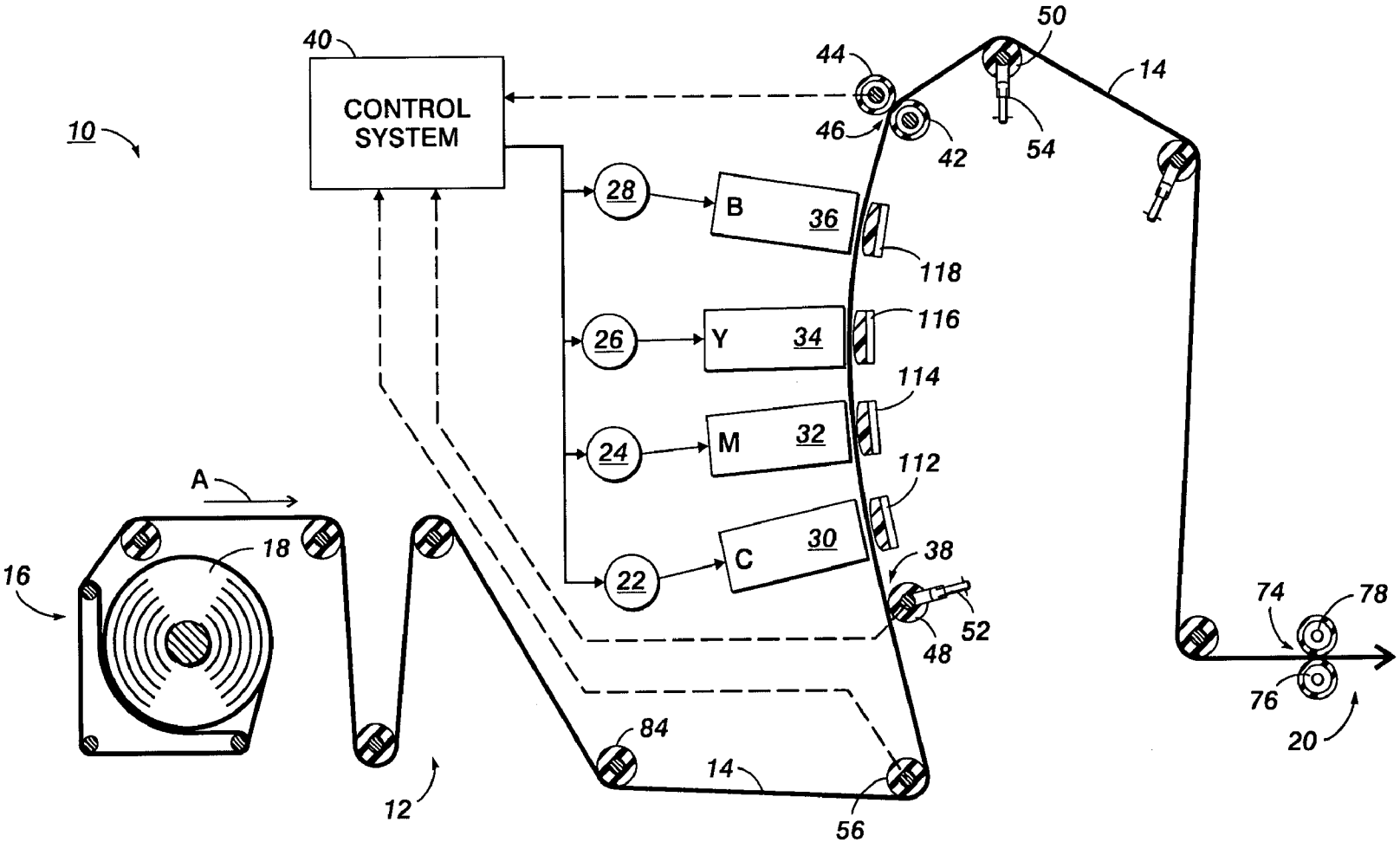
FIG. 1 is a schematic elevational view of an imaging device in accordance with one aspect of the exemplary embodiment.

Aspects of the exemplary embodiment relate to an imaging device and to a registration system for an imaging device. The imaging device includes an extensible image receiving member, such as a web or belt, which defines an image receiving surface that is driven in a process direction between marking stations. The process direction speed of the image receiving surface may vary over its length from a nominal set speed due, for example, to variations in stretch or deformation of the image receiving member and may vary over time due, for example to minor variations in the drive speed. The imaging surface thus has two degrees of freedom, defined by its speed and relative stretch in the receiving member.

The imaging device can include any device for rendering an image on print media, such as a copier, laser printer, bookmaking machine, facsimile machine, or a multifunction machine, all of which may generally be referred to as printers. The operation of applying images to print media, for example, graphics, text, photographs, etc., is generally referred to herein as printing or marking.

The image receiving member can be a web of print media, such as a continuous web of print media having a length substantially greater than its width and substantially greater than the distance between first and second marking stations. The print media can be paper, plastic, or other suitable physical print media substrate for images. Alternatively, the image receiving member can be a flexible belt, such as a photoreceptor belt, which may be in the form of a loop. Images applied to the belt at the first and second marking stations are transferred to a sheet of print media at a transfer station. In general, the web of print media or belt is one which has sufficient extensibility in the process direction that differences in tension in the web can result in misregistration of images applied by the first and second print stations. While the image receiving member will frequently be described herein in terms of a web of paper, it is to be appreciated that other image receiving members are also contemplated.

As used herein, an image can comprise a pattern of applied marking medium such as ink or toner. Or, the image may comprise a latent image, such as may be formed by exposing (e.g., discharging) portions of a photoreceptor belt surface, to which a marking medium such as a toner is subsequently applied.

The exemplary registration system includes a first measuring device and a second measuring device. The first and second measuring devices provide time varying information related to the web, e.g., information from which its process direction speed and/or a tension in the web can be derived and monitored as it changes overtime. The first measuring device may be at a first monitoring position and the second measuring device may be at a second monitoring position, spaced from the first position in the process direction to provide information on the web at first and second spaced positions of the web. The first measuring device may be downstream of the second measuring device. In general, one of the first and second measuring devices is positioned upstream of at least one of the marking stations and the other of the first and second measuring devices is positioned downstream of at least one of the marking stations.

In one embodiment, at least one of the first and second measurement devices provides indirect information on the web position, by measuring a property of a roller which guides the web. The indirect measuring device may comprise a position encoder or a tension measuring device, such as a stress gauge or load cell. In other embodiments, one or both of the measuring devices may directly measure a property of the web, such as its speed or tension from which web position information can be derived. Suitable direct measurement devices may include position encoders, motion sensors, or stress gauges.

The first measuring device may be an encoder which provides information from which the speed and position of the web at the first position may be derived. In one embodiment, the second measuring device may include an encoder which provides information from which the speed and position of the web at the second position may be derived. The relative speed of the web between the first and second encoder positions can be used to determine the tension in the web. In another embodiment, the second measuring device may include a tension measuring device. The tension measuring device enables a tension in the web to be derived at the second position.

Based on information from the first and second measuring devices and relative positions of first and second marking stations, timing of actuation of the first and/or second marking stations can be controlled. While in its simplest form, the exemplary registration system provides a double reflex system, which allows registration to take into account speed and tension measurements derived from information output by two measuring devices, it is to be appreciated that for more complex systems, a triple reflex or n-reflex system (where n may be two or more and may be up to ten or more) may be employed, by utilizing suitable algorithms.

With reference to FIG. 1, a first embodiment of a multicolor digital marking system 10 is illustrated in the form of an ink jet printing system. The system 10 includes a conveyor system 12, which conveys a web 14 of paper along a paper path in a process direction indicated generally by arrow A, between an upstream end 16, herein illustrated as comprising an unwinder 18, and a downstream end 20, such as a take up roller (not shown). The printing system 10 includes a plurality of marking stations 22, 24, 26, 28, one for each of the ink colors to be applied, cyan, magenta, yellow, and black, in the illustrated embodiment. The marking stations 22, 24, 26, 28 are arranged at spaced locations along the paper path. Each of the marking stations 22, 24, 26, 28 includes a print head 30, 32, 34, 36, respectively, which applies a marking media, ink in the illustrated embodiment, to an imaging surface 38 defined by one side of the paper. The print heads 30, 32, 34, 36 are under the control of a control system 40, which controls the firing of the print heads such that an image generated by the second marking station 24 (and subsequent marking stations 26, 28) is superimposed over an image applied by the first marking station 22. The control system 40 may comprise a central processing unit (CPU) which executes instructions stored in associated memory for generating firing times/adjustments for the print heads, or the control system may be another suitable computer controlled device. In one embodiment, the control system 40 may form a part of an overall control system for the imaging device 10, which also provides image data to the marking stations.

The illustrated conveyor system 12 includes a plurality of guide members such as rollers, which guide the paper web 14 past the marking stations, generally through contact with the web. At least one of the rollers 42 is a drive roller which is driven in the process direction by a motor or other suitable drive system (not shown). The drive roller 42 engages a second roller 44 to form a drive nip 46 therebetween. The driven roller 42 applies a driving force to the paper web as it passes through the nip 46. The drive motor is configured for driving the drive roller 42, and hence paper web 14, at a substantially constant preset speed. However, the speed of the driven roller 42 may fluctuate over time, i.e., vary from its preset speed, such that the speed of the web passing through the nip 46 also fluctuates slightly over time. The second roller 44 may be a driven roller or a non-driven (idler) roller. In the illustrated embodiment, the print heads 22, 24, 26, 28 are spaced along the paper path at various distances upstream from the nip 46.

One or more rollers 48, 50, etc, downstream and/or upstream of the driven roller 42 may be tension rollers. The tension rollers 48, 50 attempt to maintain a constant tension on the web 14 without applying a driving force. Rollers 48, 50 may be biased towards the web 14 by a tension member 52, 54, such as a spring, to create a small amount of tension in the web to keep the web taut as it moves through the printing system 10. The tension applied to the web results in a minor amount of stretching of the web in the process direction. Variations in the tension may occur over time. As a result, the speed of the web at the heads 30, 32, 34, 36 may vary over time (either higher or lower) from that at the nip 46. Other rollers such as roller 56, upstream of the heads, may serve a guiding function, with or without applying any tension.

Information on the web 14 is obtained at two spaced monitoring positions along the paper path, which enables both the web speed and the tension of the web to be factored into a relative firing time of successive print heads. In one embodiment, the information is obtained at a first web position downstream of all the print heads, and at a second web position upstream of all the print heads. However, the locations of first and second positions can be anywhere along the paper path where information on web speed and tension in the paper path adjacent the heads can be obtained. In the illustrated embodiment, information from positions downstream of nip 46 is not useful. However, in other systems where the drive nip is upstream of the heads, downstream information may be useful. In general, the measuring devices are located no further from the marking stations than the drive nip.

Figure 2:
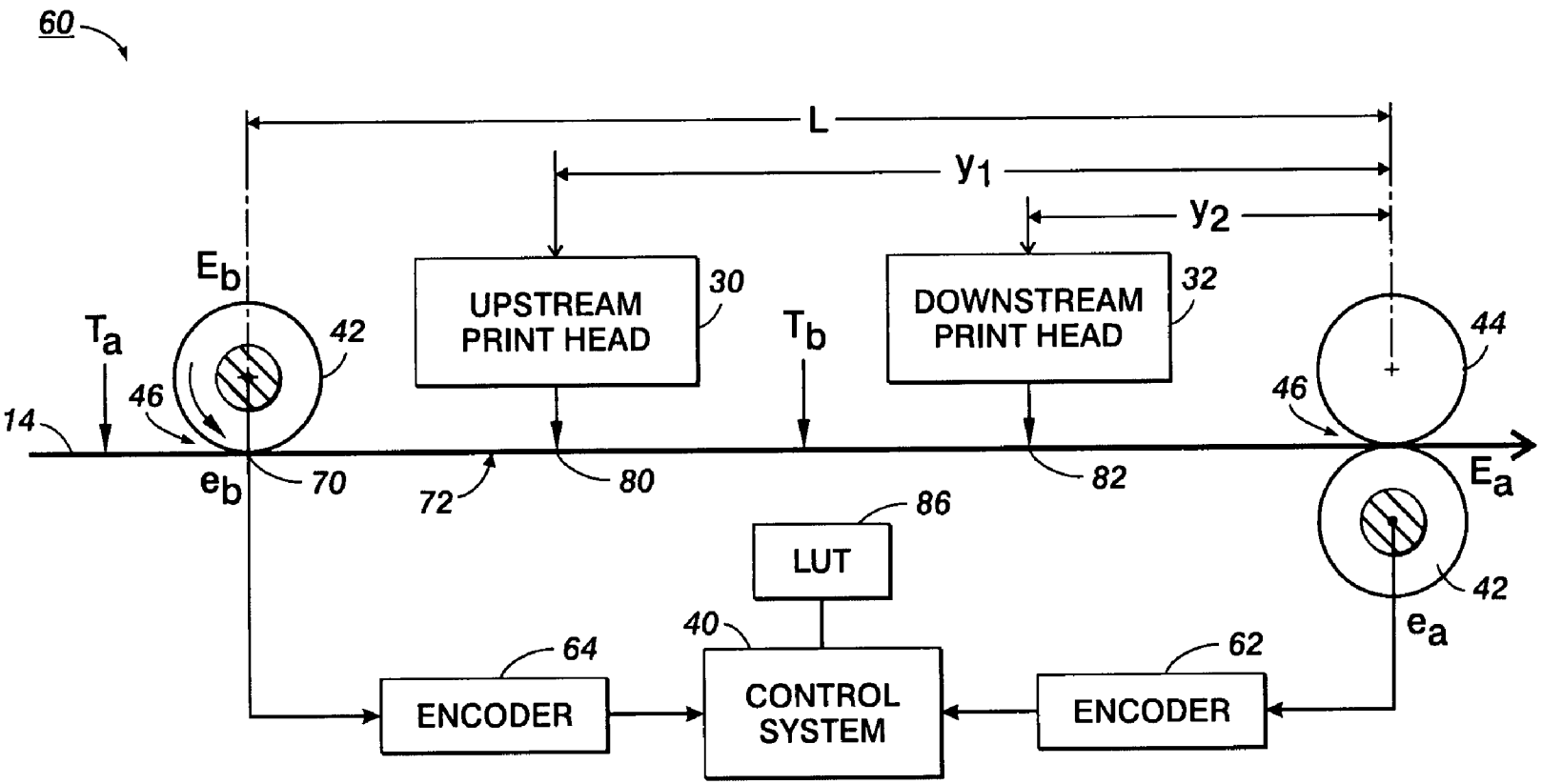
FIG. 2 is a schematic elevational view of a first embodiment of a registration system for the imaging device of FIG. 1.

With reference to FIG. 2, a first embodiment of a registration system 60 for an imaging device such as imaging device 10 is shown. FIG. 2 shows only two print heads 30, 32, for ease of representation, although it is to be appreciated that three, four, or more print heads may be provided, as shown in FIG. 1. The registration system 60 includes a first measurement device in the form of an encoder 62, which is associated with the drive roller 42 (or alternatively with driven roller 44) and a second measurement device in the form of an encoder 64 associated with roller 56. Both of the encoders 62, 64 may be rotary encoders which are mounted to an axial shaft of the respective roller in a location outwardly spaced from the nip region 46 (or web contacting region in the case of roller 56). Although roller 56 is a single roller, it is also contemplated that roller 56 may be one of a pair of rollers, similar to rollers 42, 44 which define a nip. The first encoder 62 may output a fixed number of electrical pulses (clicks) for each rotation of the drive roller 42. Based on a frequency of the clicks, a speed of the paper as it passes through the nip 46 can be determined. For example, web speed may be computed by multiplying the circumference of the driven roller 42 (which may be increased to account for the thickness of the web) by a constant value (a function of the number of clicks per revolution) times the frequency of the clicks (e.g., clicks/second). The encoder information, either as the unprocessed raw data or a calculated web speed, is communicated to the control system 40.

In a conventional reflex printing system, the web speed, in the process direction, is determined from a single encoder, which may be analogous to encoder 62. In the conventional system, it is assumed that the speed of the web at the print heads spaced from the encoder is the same as the web speed at the encoder. The heads of each color are then each fired sequentially a set number of encoder pulses apart, based on the determined speed. Absent stretching of the web, the color on color registration should generally be compensated for by this method. However, due to time varying changes in tension of the web, this assumption fails to provide accurate registration throughout printing.

Paper, for example, is a very stretchable medium. A 75 gram per square meter (gsm) paper typically has a Young's Modulus such that at a typical one pound per inch (approximately 0.18 kg/cm) web tension will cause the paper web to stretch by about 0.1%. In a system with an 0.8 m separation between print heads, such a stretch can represent about an 800 μm position difference. In a conventional system, the firing of the second print head is adjusted to reflect the stretch in the web at the time a test print is obtained by adjusting the firing until lines produced by the first and second print heads are aligned. However, the tension in the web can vary over time. A 20% change in tension, for example, may result in a misregistration of about 160 μm using the conventional single reflex registration control. In a printing system operating at 600 lines per inch, for example, the lines are about 42 μm apart. Accordingly, a misregistration of 160 μm is significant and is typically noticeable to the unaided eye of an observer examining the image. In the exemplary embodiment, the misregistration can generally be reduced such that it is maintained at less than the width of a scan line, and can, in theory, be compensated for completely.

In the exemplary double reflex registration system 60, the first and second measurement devices both provide web position information. For example, the second measuring device 64 is used by the control system 40 to account for the variation in stretch of the web over time. In this way, the firing of the print heads 30, 32, 34, 36 can be adjusted by the control system 40 to account for both a change in the measured speed of the web 14 and a change in stretch in the web.

In the registration system 60, illustrated in FIG. 2, the second measuring device, illustrated as encoder 64, measures the speed of roller 56 and hence the speed of web at a contact zone 70. In the exemplary embodiment, roller 56 is a guide roller, although it may alternatively be a driven roller or a tension roller. The speed of the web at roller 56 may vary, slightly, from the set speed, as for roller 42, resulting in changes in tension, over time in a printing zone 72 of the paper web which extends between the two contact zones 46, 70. Encoder 64 may be similarly configured to encoder 62. In particular, encoder 64 outputs a fixed number of pulses (clicks) for each rotation of the guide roller 56. Based on a frequency of the clicks, a speed of the paper web 14 as it passes through the zone 70 can be determined as discussed above. The encoder information, either the unprocessed raw data or a calculated web speed, is communicated to the control system 40.

The encoder 62 provides a first source of web-speed related information, namely the rotation speed of the drive roll 42, from which the speed of the paper passing through nip 46 can be derived. The encoder 64 provides a second source of web-speed related information, namely the rotation speed of the guide roll 56, from which the speed of the paper passing through zone 70 can be determined. In the illustrated embodiment, the first encoder 62 provides information for determining the web speed at a position 46 downstream of the second print head 32 and the second encoder 64 provides information for determining the web speed at a position 70 upstream of that of the first encoder 62 and upstream from the first print head 30. In the exemplary embodiment, the print heads 30, 32 of the first and second marking stations 24, 26 are located intermediate the first and second monitoring positions 46, 70.

Based on a determination of the web speed at positions 46 and 70, a tension $T_b$ in the printing zone 72 of the web 14 between the two positions 46, 70 can be calculated. In the embodiment illustrated in FIG. 2, there are no significant additional sources of tension between the two monitoring positions 46, 70 so the tension can be presumed to be the same throughout printing zone 72.

In one embodiment, the position and tension $T_b$ in the web is determined from the difference in speed determined at the first and second positions 46, 70 and the Young's modulus of the web. This determination may also rely on an input tension $T_a$ being known. Since the modulus of the web, clicks/revolution of each encoder, and dimensions of the rollers are all constants, the tension $T_b$ can be determined as a function of the two click frequencies. Based on the determined tension $T_b$ in the web, a firing time adjustment can be determined for the downstream marking station 24 to account for any change in tension of the web from the tension when the firing time was set. The firing time adjustment is also based on a change in web speed, which for a print head intermediate the two positions 46, 70, can be determined as a function of its distance from the measurement positions. The adjustment is thus based on the position of the first and second print heads 30, 32, relative to the first and second positions 46, 70.

For example, the distances $y_1$, $y_2$ and L, which are fixed, may be known, where $y_1$ represents the distance from the first position 46 to a position 80 on the web at which a line of an image from print head 30 is to be applied, $y_2$ represents the distance from the first position 46 to a position 82 on the web at which a line of an image from print head 32 is to be applied in superimposition on the first line and L represents the distance between the first and second positions. As will be appreciated, the change in tension in the web affects the time at which a specific portion of the web reaches both print head 30 and print head 32, however, in the present case, the firing times of only one of the two print heads (print head 32 for example) is adjusted, based on their relative positions along distance L.

Thus for example, where print head 32 was originally set to fire x clicks of encoder 62 (or encoder 64) after print head 30, the firing time may be adjusted to x+y counts to provide good alignment of image lines, where y may be a positive value in the case of an increase in web tension and y may be a negative value in the case of a decrease in tension. Note that an increase in tension signifies that the tension in the web 72 between positions 46 and 70 is higher than at the time the original value of x was determined.

In one embodiment, reflex timing can be determined from the time varying information of $E_a$ (change in encoder 62 count) and a real time measurement of the tension $T_b$ in the printing zone, as well as the distance to the second encoder and the Young's modulus M of the media. The paper position may be calculated by integrating the time variation of the tension. For example, for the embodiment of FIG. 2, once $E_a$, $E_b$, $T_a$, $T_b$ are determined, the heads may be fired proportional to the following dynamic sum:

$$\alpha E_b/(1+T_a/M)+\gamma E_a/(1+T_b/M) \qquad \text{Eqn. 1}$$

where $$\gamma=\text{dpi}*e_a*(L-y)/L$$

$$\alpha=\text{dpi}*e_b*(y)/L$$

$T_b$ is the tension per cross-sectional area of the web in the region 72 of the print heads $T_a$ is the tension per cross-sectional area of the web in a region upstream of the first encoder dpi is the dots per inch spacing between lines.

M is the Youngs modulus of the web.

$e_a$ and $e_b$ are the distances traveled by the respective encoders per click.

$E_a$ and $E_b$ are the change in the respective encoder values since the last fire of a given one of the print heads.

$y_1$ is used for y in the case of print head 30 and $y_2$ in the case of print head 32.

In one embodiment, the values of α and β may be adjusted empirically to achieve the best registration.

In one embodiment, where there is no dynamic measure of the tension $T_a$ and additionally $T_b$ may not be known. In this embodiment, $T_a$ and/or $T_b$ may be assumed to be a constant for purposes of the calculations.

In another embodiment, in addition to information from the two encoders 62, 64 to provide a tension measurement $T_b$ within the printing zone 72, a tension measurement $T_a$ in a portion of the web prior to the second (upstream) encoder 64 is made. For example, $T_a$ may be estimated by using information from a tension measuring device (not shown) associated with an upstream tension roller 84 (FIG. 1). In this case, $T_b$ may be calculated from the two encoder signals $E_a$ and $E_b$ (and $T_a$) according to the continuous integration where:

$$\delta\{e_a/[L(1+T_b/M)]\}=(e_a/L)\{\delta E_b e_b/[L(1+T_a/M)]-\delta E_a e_a/[L(1+T_b/M)]\}$$

where δ is the change in the operand since the last fire.

In one embodiment, the count to determine the time between firing cycles may be given by the running sum:

$$\alpha/E_a(1+T_b/M)+\gamma/E_b(1+T_b/M) \qquad \text{Eqn. 2}$$

Eqn. 1 may provide a technique which is less prone to roundoff error than Eqn. 2. A less accurate but reasonable variation on this technique, however, is to assume that one or both of $T_a$ and $T_b$ are constants and perform the sum based only on $E_a$ and $E_b$.

It is to be appreciated that second order effects in a real imaging device may cause variations from this theoretical firing and in practice a lookup table (LUT) 86 may be employed which takes into account additional factors. In one embodiment, the look up table 86 may be accessed by inputting values of at least the two encoder count frequencies $E_a$ and $E_b$. The LUT 86 would then output an adjusted firing time for the second (or first) print head 32, 30 to account for the change in tension associated with the $E_a$ and $E_b$ values and any other factors influencing the tension. This process may be repeated at a suitable time interval and the firing time updated accordingly.

Figure 3:
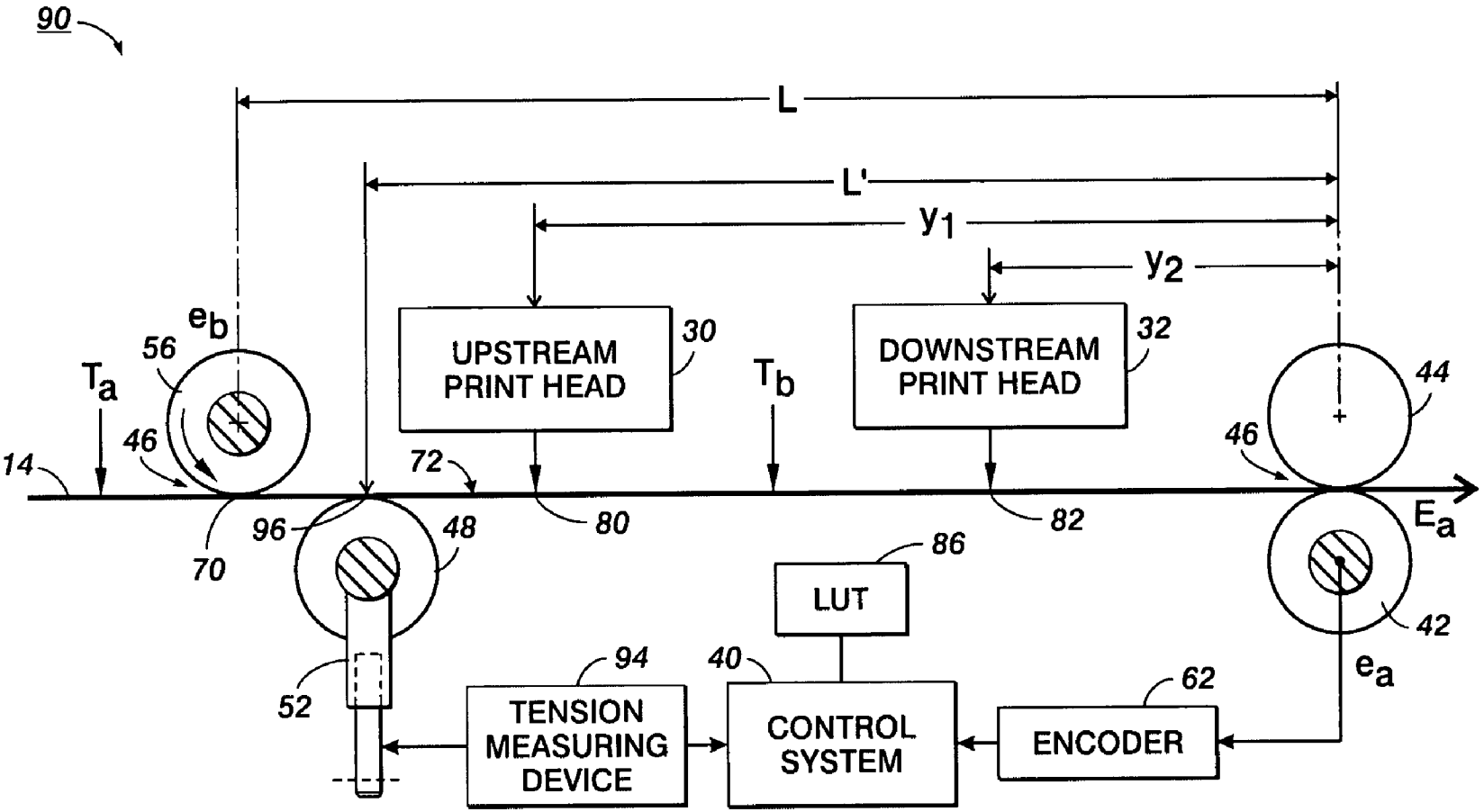
FIG. 3 is a schematic elevational view of a second embodiment of a registration system for the imaging device of FIG. 1.

With reference to FIG. 3, another embodiment of a registration system 90 for an imaging device, such as device 10 is shown. In this embodiment, similar elements are accorded similar numerals and new elements are accorded different numerals. In this embodiment, a tension roller 48 is biased towards the web by a tension member 52, such as a spring under compression (or under tension if the spring force is applied from an opposite side of the web to the roller 48). The tension roller 48 thus generates a tension to the web which is related to the compression/tension force in the tension member 52. A tension measuring device 94, such as a stress gauge, measures the tension $T_s$ in the tension member 52 (which can be a compressive force or tension force). The tension measuring member measures the tension at a position 96, upstream of heads 30, 32 and position 46. Since there are no causes of tension between the position 96 and the heads 30, 32, it can be assumed that the tension $T_b$ throughout portion 72 is the same as at position 96 and therefore $T_b$ can be derived from $T_s$ The measurement of $T_s$ is therefore used by the control system 40 to determine changes in the tension $T_b$ in the printing zone 72 over time. As for the embodiment of FIG. 2, the tension $T_b$, in combination with the count frequency $E_a$ can be used to determine a modification to the firing time of print head 32 (or print head 30) whereby the images from the two print heads are brought into better alignment. In this embodiment, the LUT 86 is input with the encoder frequency $E_a$ and the stress gauge measurement $T_s$ and outputs a modified firing time for print head 32 (or print head 30) based on these inputs.

In the embodiment of FIG. 3, the tension measuring device 94 is a distance L' from position 46, i.e., upstream of both print heads 30, 32, although it is to be appreciated that the tension measuring device may be at any position upstream of nip 46 to enable the tension in web portion 72 to be determined, e.g., between heads 30, 32, or downstream of both of them. The distance L'is not of particular relevance (as opposed to simply L) where the tension is constant throughout the entire length of L.

For example, the tension measuring device 94 is used to measure $T_b$. Knowing $T_b$ the heads can be fired with relative timing proportional to the following sum:

$$\text{dpi}[e_a E_a/(1+T_b/M)+y\delta\{1/(1+T_b/M)\}]$$

Figure 4:
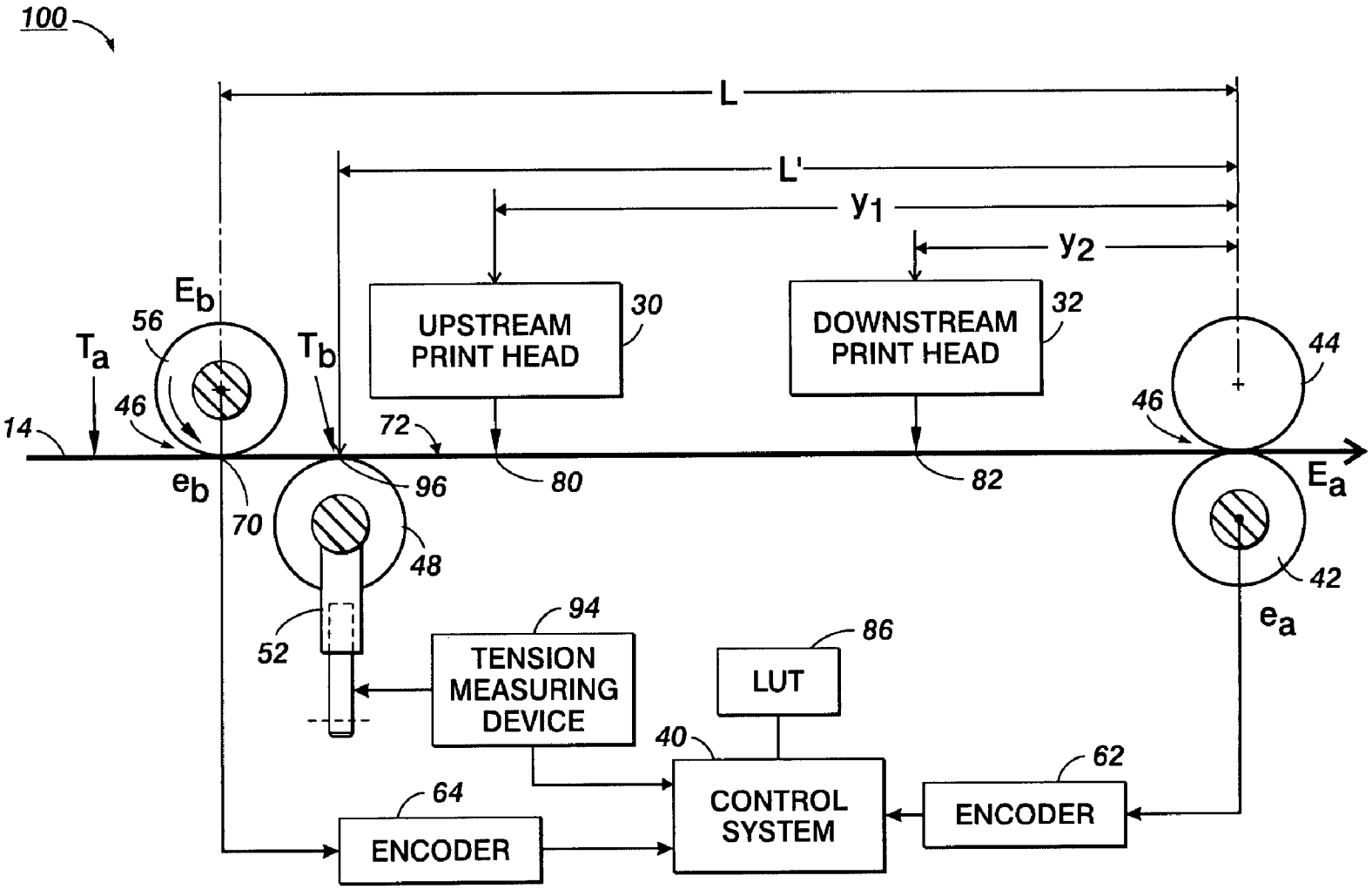
FIG. 4 is a schematic elevational view of a third embodiment of a registration system for the imaging device of FIG. 1.

With reference now to FIG. 4, another embodiment of a registration system 100 for an imaging device, such as device 10 is shown. In this embodiment, similar elements are accorded similar numerals and new elements are accorded different numerals. In this embodiment, information from tension roller 48 and encoders 62, 64 is used in determining the respective firing times of the two print heads 30, 32. A tension measuring device 94, such as a stress gauge, measures the tension $T_s$ in the tension member 52. A guide roller 56, upstream of the tension roller 48 has an encoder 64 is mounted to it, which is used to determine the count frequency $E_b$ of roller 56. In this embodiment, the timing of the firing of the downstream print head 32 (or print head 30) is computed as a function of at least three variables: $E_a$ (which is related to the speed of the web at nip 46), the tension $T_s$ in tension member 52, and $E_b$ (related to the speed of the web at position 70). For example, the control system 40 may use the values of $E_a$, $E_b$, and $T_s$ to determine changes in the tension $T_b$ in the printing zone 72 over time and or determine a modified firing time for print head 32 (or print head 30) whereby the images from the two print heads are brought into better alignment. In this embodiment, the LUT 86 may comprise a three dimensional look up table or suitable algorithm for outputting a modified firing time based on the values of $E_a$, $E_b$, and $T_s$ (where $T_s$ generally equals $T_b$).

In the embodiment of FIG. 4, where $E_a$, $E_b$ and $T_b$ are known, Eqn. 1 above may be used to determine the relative firing times. Once again, the value of $T_a$ is either known or assumed known and constant.

In the embodiments of FIGS. 3 and 4, it assumed that roll 48 has little or no effect on the tension, i.e., the tension $T_b$ upstream of roll 48 is the same as that downstream. For example, roll 56 may have a captured nip or enough wrap on it (as shown in FIG. 1) such that the roll has the capability of modifying the tension, whereas roll 48 has such a light wrap that it does not. In another embodiment where roll 48 does modify tension, the differences in upstream and downstream tension may be factored in to the determination of firing times.

As will be appreciated, in any registration system, an appropriate relationship between two or more variables, such as values of $E_a$, $E_b$, and/or $T_s$ and the firing time may be determined empirically or through a theoretical calculation similar to Eqn. 1 or Eqn. 2.

In all of the exemplary embodiments, the firing time algorithm may attend to roundoff error which may occur when dealing with encoders with realistic numbers of counts per revolution. The roundoff errors can be handled using standard techniques for carrying over roundoff errors to the next firing line.

The number of encoders and/or tension measuring devices is not limited to those shown in the exemplary embodiments. For example, the system may comprise one, two, three, four or more encoders and/or zero, one, two, three, four or more tension measuring devices. A combination signal from the multiple encoders may be utilized to provide the timing for each marking station. Additionally or alternatively, a second, third or even more encoder(s) be added to the system and a combination of the signals from these multiple encoders be utilized to predict the correct firing time for each color marking station.

As discussed above, it is also contemplated that one or more speed and/or tension measuring devices may be associated with the web directly to provide a direct measure of the speed/tension of the web at one or more positions in the region 72.

Additionally more complex printing systems with multiple nips between multiple marking stations may benefit from a registration system as described herein. In this case, multiple encoders (e.g., one encoder for every nip) may be employed and the control system may interpolate and calculate the head firing according to more complex algorithms.

In imaging devices where one or more of the print heads is downstream of a drive nip or tension roller and one or more of the print heads is upstream of the drive nip or tension roller, speed and tension related information may be obtained for two print zones.

By comparison, in a single reflex system with a single encoder, the firing time may be proportional to the sum $$\text{dpi } E_a e_a/(1+T_b/M)$$

The effect of tension on the stretch factor is usually ignored. The delay between the first and second print heads to start of firing is:

$$E_{delay}=(1+T_b/M)(y_2-y_1)/e_a$$

Assuming a nominal paper tension T' of about 1 lb/in (about 0.18 kg/cm), a paper Young's modulus M of about 300,000 lbs/in$^2$ (about 21,092 Kg/cm$^2$), a thickness of about 0.004 in (about 0.01 cm), a nominal web stretch factor $(1+T_b/M)$ of about 1.0008, and assuming the imaging device has a first to last print head distance of 1000 mm, for a single reflex system, the tension registration over the span of the two print heads with and without considering the nominal stretch factor effect would be 800 μm. When the stretch factor is considered and if the tension varies by ±10%, the registration difference would be in a range of about 80 μm.

In the exemplary double reflex system, in contrast, the algorithm is theoretically accurate when the tension over the span between any pair of first and second marking stations is independent of location and the paper is uniform. Errors may be introduced from the tension and encoder's measurement errors, measurement delays and software delays. If for any reason a differential tension is induced within the printing zone (for example, friction between the print head and the paper or between the web and backer bars 112, 114, 116, 118)

errors may be introduced. In this case, another encoder at the particular location (e.g. triple reflex, etc. techniques) may be employed. However, even if the tension does vary between print heads, this variation is relatively small, in comparison with the time varying tension changes measured by the encoders and the double reflex system still provides an improvement over the single reflex system.

The exemplary registration system 60, 90, 100, may also find application in printing systems which utilize photoreceptor belts and/or intermediate transfer belts whenever there is a concern that the belt modulus and the tension stability are such that there will be appreciable belt stretch.

Figure 5:
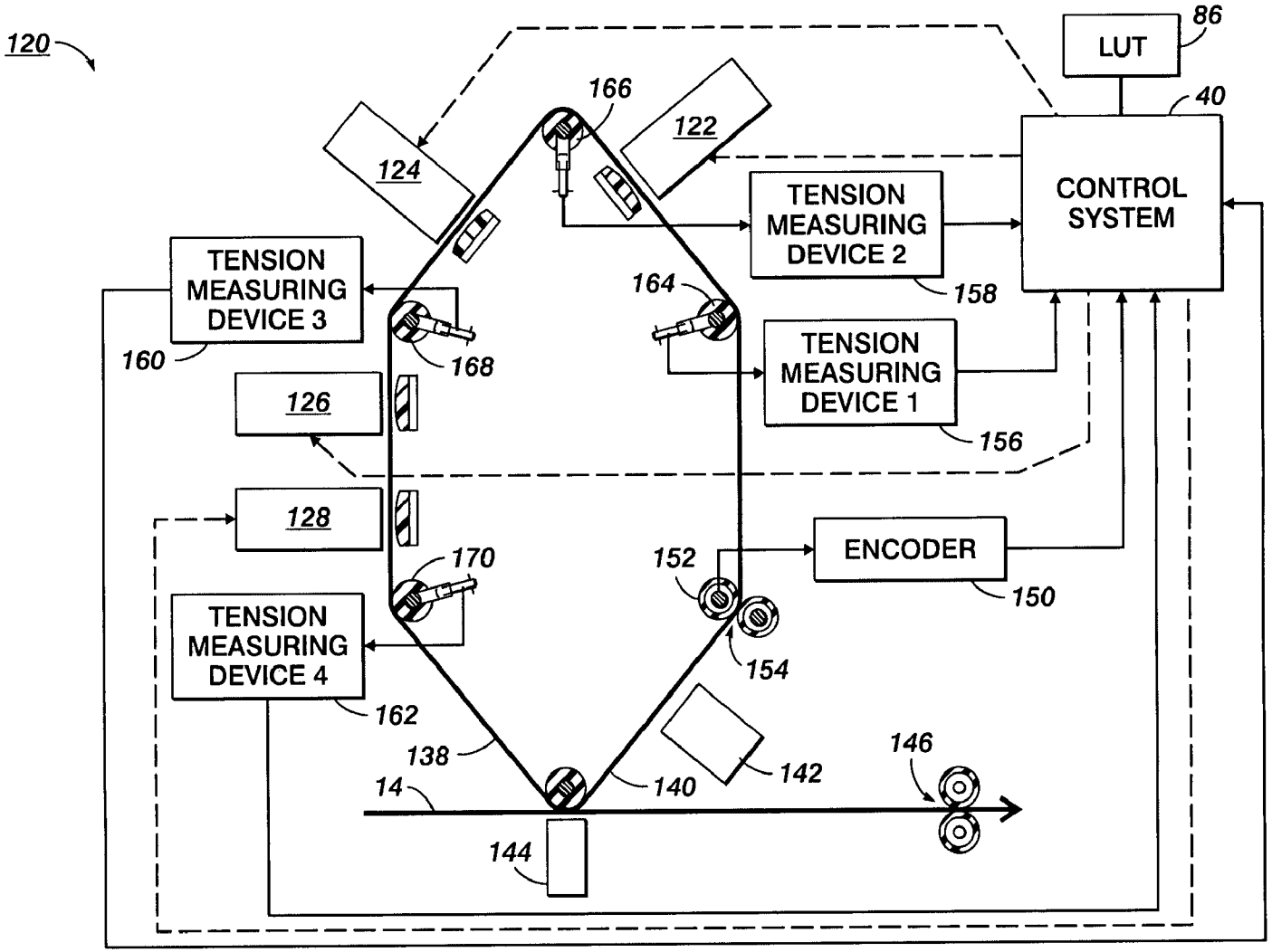
FIG. 5 is a schematic elevational view of an imaging device in accordance with another aspect of the exemplary embodiment in which the registration systems of FIGS. 2-4 may be employed.

With reference to FIG. 5, another embodiment of an imaging device 120 in the form of a xerographic printer is shown. In this embodiment, marking stations 122, 124, 126, 128 are arranged around a continuous photoreceptor belt 140. An imaging surface 138 (analogous to paper web surface 38) is defined by a surface of a photoreceptor belt 140. In this embodiment, each of the marking stations includes xerographic components, typically a charging station for the colors to be applied, such as a charging corotron, an exposure station, which forms a latent image on the photoreceptor, and a developer unit, associated with the charging station for developing the latent image formed on the surface of the photoreceptor by applying a toner to obtain a toner image. The firing of the exposure station(s) may be controlled in a similar way to that of the print head(s) in the earlier embodiment to take into account the speed of the photoreceptor belt and the variation in tension in the belt over time.

As will be appreciated, the imaging device 120 may include other hardware elements employed in the creation of desired images by electrophotographical processes, such as a cleaning device 142 and a transferring unit, such as a transfer corotron 144, which transfers the toner image thus formed to the surface of a print media substrate, such as a sheet of paper 14, and a fuser 146, which fuses the image to the sheet. The fuser generally applies at least one of heat and pressure to the sheet to physically attach the toner and optionally to provide a level of gloss to the printed media.

In the illustrated embodiment, the photoreceptor belt speed and tension may vary between marking stations 122 and 124, for example, as well as between marking station 124 and 126. Accordingly a more complex algorithm may be employed by the control system to adjust the firing time of the charging stations to provide correct registration. For example, in the illustrated embodiment, an encoder 150 is associated with a drive roller 152 for determining the speed of the belt at a drive nip 154. Tension measuring devices (TMDs) 156, 158, 160, 162 determine the tension provided by tension rollers 164, 166, 168, 170, respectively. Information from the encoder 150 and one or more of the tension measuring devices 156, 158, 160, 162 may be used by the control system 40 to determine firing time adjustments for marking stations 124, 126, 128, in a similar manner to that described for FIGS. 2-4. Alternatively or additionally, information from two (or more encoders) may be used in determining the firing time adjustments. In particular, for any marking station, there are two degrees of freedom (belt speed and belt stretch).

The double or multiple reflex printing technique disclosed herein, although generally not a substitute for-ensuring adequate tension controls within a belt/web system, generally improves registration and reduces the tolerance on the web/belt/tension handling mechanical systems.

It is to be appreciated that encoder devices could be used other than the rotary encoders disclosed herein, i.e., any device that directly or indirectly measures the belt or web speed at a given point. In any of the embodiments, one or more direct measuring devices, such as encoders and/or motion sensors or stress gauges may be used to measure the belt speed or tension in place or in addition to the indirect measuring devices shown.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An imaging system comprising:

an image receiving surface which is moved in a downstream direction;

a first marking station which applies a first image to the image receiving surface;

a second marking station, downstream of the first marking station, which applies a second image to the image receiving surface;

first and second measuring devices which output time varying information related to the moving image receiving surface;

a control system in communication with the first and second marking stations and the first and second measuring devices, the control system being configured for receiving the time varying information and determining a modified actuation time of at least one of the first and second marking stations using an equation or look up table, whereby the information provided by the first and second measuring devices is used to account for a change in tension of the image receiving surface from a tension when the actuation time was set.

2. The imaging system of claim 1, further comprising a drive member for moving the image receiving surface between the first and second marking stations and wherein the first measuring device is associated with the drive member.

3. The imaging system of claim 1, wherein the first measuring device is downstream of at least one of the first and second marking stations and the second measuring device is upstream of at least one of the first and second marking stations.

4. The imaging system of claim 1, wherein the image receiving surface is defined by an extensible medium.

5. The imaging system of claim 1, wherein the imaging surface comprises a surface of a print medium.

6. The imaging system device of claim 5, wherein the print medium comprises a paper web of print media having a length greater than a distance between the first and second marking stations.

7. The imaging system of claim 6, wherein the first and second marking stations comprise print heads which eject ink onto the image receiving surface to form the images.

8. The imaging system of claim 1, wherein the imaging surface comprises a surface of a belt, the images being transferred from the belt to a print medium.

9. The imaging system of claim 1, further comprising a drive nip for moving the image receiving surface and wherein the measuring devices are located no further from the marking stations than the drive nip.

10. The imaging system of claim 1, wherein the first measuring device provides information which enables a variation in at least one of speed and position of the image receiving surface to be monitored and the second measuring device provides information which enables monitoring of at least one of:

a variation in tension of the image receiving surface, and a variation in at least one of speed and position of the image receiving surface.

11. The imaging system of claim 1, wherein at least one of the first and second measuring devices comprises an encoder.

12. The imaging system of claim 11 wherein the first measuring device comprises a first encoder and the second measuring device comprises a second encoder.

13. The imaging system of claim 11, wherein the first measuring device comprises an encoder associated with a first roller which rotates as the imaging surface travels in the downstream direction.

14. The imaging system of claim 13, wherein the first roller is downstream of the first and second marking stations.

15. The imaging system of claim 13, wherein the second measuring device comprises a second encoder associated with a second roller, upstream of the first roller, which rotates as the imaging surface travels in the downstream direction.

16. The imaging system of claim 11, wherein the control system uses information from the first and second encoders to determine a variation in tension of the image receiving surface.

17. The imaging system of claim 11, wherein the second measuring device comprises a tension measuring device which enables a variation in tension of the image receiving surface to be determined.

18. The imaging system of claim 17, wherein the tension measuring device comprises a stress gauge.

19. The imaging system of claim 1, wherein the control system determines the modified actuation time of the at least one of the first and second marking stations based on a distance of the marking station from at least one of the first and second measuring devices.

20. The imaging system of claim 1, further comprising a third measuring device, the control system being configured for determining a modified actuation time of at least one of the first and second marking stations based on the information provided by the first, second, and third measuring devices.

21. The imaging system of claim 20, wherein the first measuring device includes a first encoder, the second measuring device includes a second encoder, and the third measuring device includes a tension measuring device.

22. An imaging device comprising:

an image receiving surface which is moved in a downstream direction;

a first marking station which applies a first image to the image receiving surface;

a second marking station, downstream of the first marking station, which applies a second image to the image receiving surface, the first and second marking stations comprising print heads which eject ink onto the image receiving surface to form the images;

first and second measuring devices which output time varying information related to the moving image receiving surface; and a control system in communication with the first and second marking stations and the first and second measuring devices, the control system being configured for receiving the time varying information and determining a modified actuation time of at least one of the first and second marking stations based on the information provided by the first and second measuring devices to account for a change in tension of the image receiving surface from a tension when the actuation time was set.

23. The imaging system of claim 22, wherein the first marking station comprises a first print head and the second marking station comprises a second print head and wherein the control system determines a modified firing time of at least one of the first and second print heads based on the information provided by the first and second measuring devices to account for a change in tension of the image receiving surface from a tension when the firing time was set.

24. The imaging system of claim 22, wherein the image receiving surface is a continuous web of print media having a length greater than a distance between the first and second marking stations

25. A method of registering images, comprising:

moving an image receiving surface;

applying images to the image receiving surface at first and second spaced image applying positions by ejecting ink onto the image receiving surface to form the images;

monitoring a speed of the image receiving surface at a first monitoring position spaced from the first and second image applying positions;

monitoring a tension in the image receiving surface;

controlling a timing of firing of inkjets for the application of at least one of the first and second images in response to the monitored speed and tension in the image receiving surface.

26. The method of claim 25, wherein the monitoring of the tension includes monitoring a speed of the image receiving surface at a position spaced from the first monitoring position.

27. The method of claim 25, wherein the monitoring the tension includes monitoring at least one of a speed and a tension of the image receiving surface at a second monitoring position and wherein one of the first and second monitoring positions is upstream of the at least one of the first and second image applying positions and the other of the first and second monitoring positions is downstream of at least one of the first and second image applying positions.

28. A registration system comprising:

first and second measuring devices which output time varying information related to an associated moving image receiving surface;

a control system which determines a relative actuation time for first and second associated marking stations, based on the time varying information from the first and second measuring devices, the control system using an equation or look up table whereby variations in speed and tension in the image receiving surface are taken into account in registration of images generated by the first and second marking stations which are applied to the image receiving surface at spaced positions.

29. The registration system of claim 28, wherein the first and second measuring devices each comprise a device selected from the group consisting of an encoder, a motion sensor, and a tension measuring device, and combinations and multiples thereof.

30. The registration system of claim 28, wherein the first and second measuring devices comprise first and second encoders.

31. A registration system comprising:

an encoder associated with a first roller which guides an associated image receiving surface thereon, the encoder outputting a fixed number of electrical pulses for each rotation of the first roller;

at least one of a second encoder associated with a second roller which guides the image receiving surface thereon and a tension measuring device which provides information on a tension applied by the second roller; and a control system which receives information from the encoder and the at least one of the second encoder and the tension measuring device and, based on the information from both the encoder and the at least one of the second encoder and the tension measuring device, determines an actuation time for a marking station for registering an image applied to the image receiving surface by the marking station with an image applied to the receiving surface by another marking station.

* * * * *